United States Patent [19]

Reuland

[11] 4,423,742

[45] Jan. 3, 1984

[54] METHOD AND APPARATUS FOR DETECTING SOFT SECTIONS OF TOBACCO FILLERS

[75] Inventor: Joachim Reuland, Neu-Börnsen, Fed. Rep. of Germany

[73] Assignee: Hauni-Werke Körber & Co. KG, Hamburg, Fed. Rep. of Germany

[21] Appl. No.: 302,240

[22] Filed: Sep. 14, 1981

[30] Foreign Application Priority Data

Sep. 18, 1980 [DE] Fed. Rep. of Germany ..... 3035166

[51] Int. Cl.[3] ..... A24C 5/18

[52] U.S. Cl. ..... 131/84 C; 131/906

[58] Field of Search ..... 131/84 C, 906

[56] References Cited

U.S. PATENT DOCUMENTS

| | | | |
|---|---|---|---|
| 3,604,429 | 9/1971 | DeWitt | 131/906 |
| 3,604,430 | 9/1971 | Norwich | 131/906 |
| 3,742,795 | 7/1973 | Lipcon et al. | 131/906 |
| 4,036,238 | 7/1977 | Okumotto | 131/906 |
| 4,326,542 | 4/1982 | Laszlo | 131/906 |

*Primary Examiner*—V. Millin

*Attorney, Agent, or Firm*—Kontler, Grimes & Battersby

[57] ABSTRACT

A cigarette rod making machine has a beta-ray detector which monitors the density of successive increments of the condensed filler in the continuously moving cigarette rod and changes the distance between the trimming device and the conveyor for the tobacco stream. The height of the tobacco stream (upstream or downstream of the trimming device) is monitored, and the thus obtained first signals are compared with second signals denoting the distance between the conveyor and the trimming device. The machine ejects those cigarettes whose fillers have caused the generation of first signals denoting that the corresponding portion of the stream contains less than a minimum acceptable quantity of tobacco. The height of successive increments of the stream can be monitored by an opto-electronic or capacitive detector or by a device which employs sound waves.

33 Claims, 4 Drawing Figures

Fig. 2
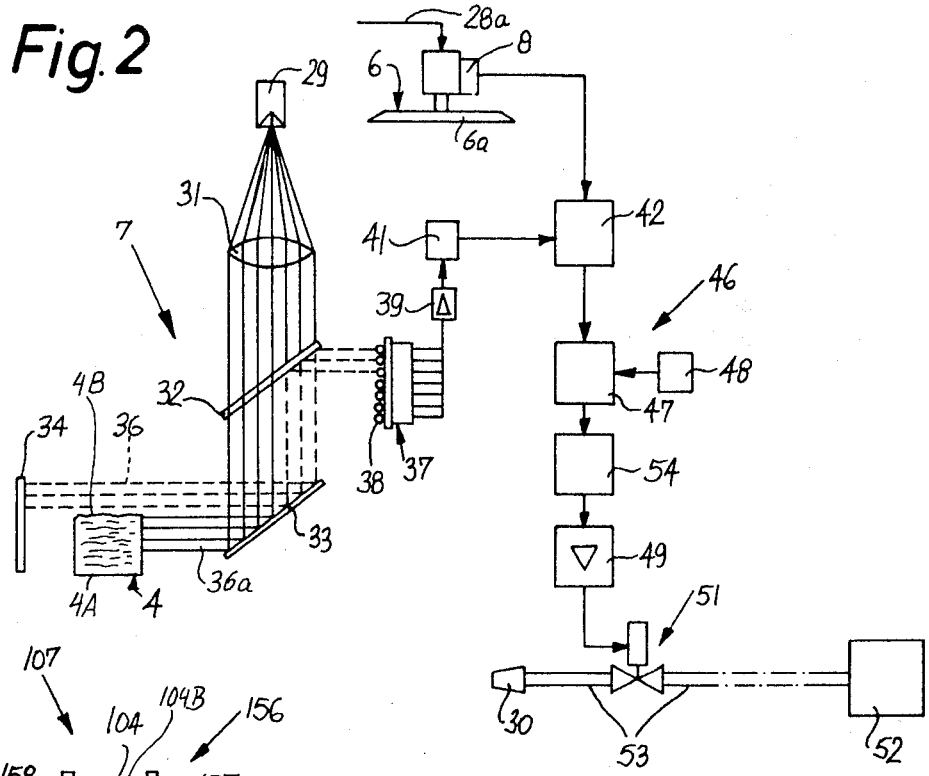
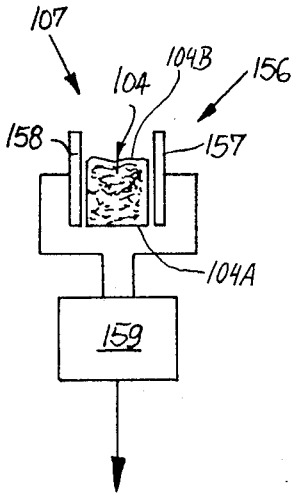
Fig. 3
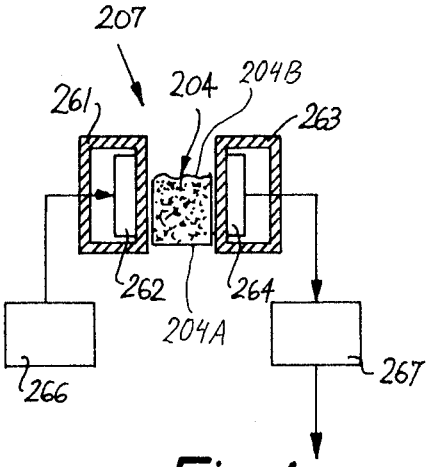
Fig. 4

METHOD AND APPARATUS FOR DETECTING SOFT SECTIONS OF TOBACCO FILLERS

BACKGROUND OF THE INVENTION

The present invention relates to a method and to an apparatus for ascertaining or detecting soft (defective) sections or portions of tobacco fillers or like bodies consisting of fibrous material. More particularly, the invention relates to a method and apparatus for evaluating the quality of tobacco fillers which are obtained by removing the surplus of tobacco from a continuous tobacco stream. Such tobacco streams are formed in cigarette making machines by showering the leading edge of a carpet or layer of tobacco shreds into a narrow channel wherein the tobacco stream grows while moving with an elongated reach of a stream-forming conveyor to which the particles of tobacco are attracted by suction. The filler is thereupon draped into a web of cigarette paper or like wrapping material and is simultaneously condensed to form a continuous cigarette rod which is severed at regular intervals to yield a succession of discrete smokers' products, such as plain cigarettes of unit length or multiple unit length. The removal of surplus tobacco from the fully grown tobacco stream is effected by a so-called equalizing or trimming device having one or more rotary knives which are movable toward and away from the stream forming conveyor in dependency on the nature of signals which are generated by a density detector placed adjacent to the path of the tobacco filler or cigarette rod.

As a rule, the density detector comprises a source of corpuscular radiation, (such as a beta ray detector) which directs radiation across the filler prior or subsequent to draping. The intensity of radiation is measured after passage through the filler. Reduction of intensity is attributable to the fact that the radiation has to penetrate across the fragments forming the filler and, if the intensity is not reduced to a sufficient extent, the measurement indicates that the corresponding portion of the filler contains less than an adequate quantity of tobacco particles. The trimming device is then adjusted in a sense to move away from the tobacco stream forming conveyor so that the filler contains a larger quantity of tobacco particles. The mode of operation is reversed if the density of the monitored filler is too high i.e., the trimming device is then caused to move toward the tobacco stream forming conveyor so as to reduce the quantity of tobacco particles per unit length of the filler.

The signals which are generated by the just discussed density monitoring device are further transmitted to a suitable segregating or ejecting device which separates the articles containing less than a requisite quantity of tobacco particles from satisfactory articles.

A drawback of presently known monitoring devices which transmit signals to ejector means for defective articles is that they are incapable of adequately or reliably detecting relatively short filler sections which contain less than the requisite quantity of tobacco. Each such relatively short section may constitute only a small portion or fragment of the filler in a cigarette of unit length or multiple unit length. It was further found that the presently known density monitoring devices, such as the aforementioned beta radiation detectors, cannot reliably ascertain all weak (insufficiently filled) portions of a tobacco filler which is advanced at a speed in access of 400 meters per minute, namely, at a speed which is customary and required in recent types of cigarette rod making machines.

OBJECTS AND SUMMARY OF THE INVENTION

An object of the invention is to provide a novel and improved method of ascertaining and pinpointing defective sections of a continuous tobacco filler with a degree of reliability which greatly exceeds that of presently known methods.

Another object of the invention is to provide a method which can be resorted to for detection of short or extremely short insufficiently filled sections of a continuous cigarette rod or the like.

A further object of the invention is to provide a method of the above outlined character which can be practiced by resorting to relatively simple and inexpensive apparatus.

An additional object of the invention is to provide a method which can be resorted to for reliably ascertaining weak spots (namely, insufficiently filled portions or sections) of rapidly advancing tobacco fillers or like continuous rod-like fibrous bodies.

Still another object of the invention is to provide a novel and improved apparatus for the practice of the above outlined method.

A further object of the invention is to provide the apparatus with novel and improved means for rapidly and reliably detecting deviations of the dimensions of a continuously moving tobacco stream from the desired or optimum dimensions.

Another object of the invention is to provide the apparatus with novel and improved means for evaluating various signals denoting the characteristics of the tobacco stream and/or the position of the trimming device preparatory to expulsion of articles which contain unsatisfactory quantities of fibrous material.

Still another object of the invention is to provide an apparatus which can be used for the practice of the above outlined method and which can be incorporated in existing cigarette making and like machines as a superior substitute for presently known apparatus.

Another object of the invention is to provide a novel and improved height measuring device for use in the above-outlined apparatus.

One feature of the invention resides in the provision of a method of detecting those portions or sections of a continuous rod-like filler of fibrous material (especially a filler consisting of or containing shredded and/or otherwise comminuted tobacco) which contain less than a desired or required quantity of fibrous material. The method comprises the steps of forming a continuous stream of variable height at least the major part of which normally contains a surplus of fibrous material, conveying the stream lengthwise in a predetermined direction and along a predetermined path so that one side of the stream contacts a first plane and the distance between the one side and another side of the stream which is located opposite the one side varies as a function of variations of the height of the stream, removing the surplus at the other side of the stream in a predetermined portion of the path including trimming the stream in a second plane which is spaced apart from the first plane whereby the thus trimmed stream is converted into the filler, monitoring the density of the filler and changing the position of one of the planes with reference to the other plane as a function of deviations of monitored density from a predetermined density, monitoring the height of successive increments of the stream (preferably in the region of the aforementioned portion of the path) and generating first signals denoting the height of corresponding increments of the stream, monitoring the distance between the two planes and generating second signals denoting the monitored distance, comparing the first and second signals, and generating third signals denoting the differences (if any) between the first and second signals.

The step of generating third signals may include generating a third signal only when the difference between the first and second signals is less than a predetermined threshold value. Thus, no third signal need be generated when a second signal indicates that the distance between the two planes suffices to ensure that the corresponding portion or section of the filler will contain an adequate quantity of fibrous material (provided, of course, that the respective tobacco stream portion which was converted into such filler portion or section did contain a surplus or not less than a minimum acceptable quantity of fibrous material) and the corresponding first signal denotes that the respective tobacco stream portion did contain at least the aforementioned minimum acceptable quantity of fibrous material.

The method may further comprise the steps of condensing the filler, draping the filler into a web of wrapping material to form a continuous wrapped filler, subdividing the wrapped filler into rod-shaped articles of preselected length, conveying such articles along a second path, and utilizing the third signals for segregation from the second path of those selected articles whose fillers have caused the generation of corresponding first signals. The density monitoring step may comprise monitoring the density of successive increments of the draped filler. The utilizing step may comprise expelling the selected articles from a predetermined portion of the second path, and the method then further comprises the step of delaying the application of third signals for segregation of corresponding selected articles until such articles reach the predetermined portion of the second path.

The step of monitoring the height of successive increments of the stream can comprise the step of ascertaining such height (i.e., the distance between the two sides of the respective increment of the stream) by a monitoring device (such as an opto-electronic detector) which is out of contact with the stream. The ascertaining step may comprise generating first signals in the form of electric signals whose characteristics (e.g., potential) vary as a function of variations of the height of the stream. The ascertaining step can further comprise moving the stream past the monitoring device so that the stream and the monitoring device overlap each other. The characteristics of electric signals are a function of the extent of overlap between the monitoring device and the stream. For example, the monitoring device can comprise two mirrors one of which reflects a beam of infrared light against the other mirror, and the stream can be caused to advance between the two mirrors, i.e., across the path of the beam. If the stream is relatively high, it intercepts a relatively large portion of the beam. The remaining portion of the beam is utilized for the generation of first signals whose characteristics are indicative of the height of corresponding increments of the stream.

The aforementioned monitoring device is or can be designed for the aforediscussed opto-electronic scanning of the distance between the first and second sides of the stream. Furthermore, and as also pointed out hereinabove, the scanning step can comprise directing infrared light against successive increments of the stream.

Alternatively, the height monitoring step can comprise ascertaining the distance between the two sides of the stream with sound waves, preferably non-audible (ultrasound) waves.

Still further, the height monitoring step may comprise capacitively measuring the distance between the two sides of the stream. Such measuring step may include resort to a high-frequency alternating electric field (e.g., by causing the stream to advance between the plates of a capacitor connected with the input of a high-frequency oscillator circuit whose output transmits first signals denoting the height of successive increments of the stream.

The height monitoring step may include measuring the distance between the two sides of the (untrimmed) stream ahead of the aforementioned portion of the path for the stream, as considered in the aforementioned direction, or measuring the distance between the two sides of the (trimmed or equalized) stream downstream of such portion.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a diagrammatic view of the apparatus which is utilized in the machine of FIG. 1;

FIG. 3 illustrates a portion of a modified apparatus; and

FIG. 4 is a fragmentary partly diagrammatic and partly sectional view of a third apparatus.

DESCRIPTION OF THE PREFERRED EMBODIMENTS

Figure 1:
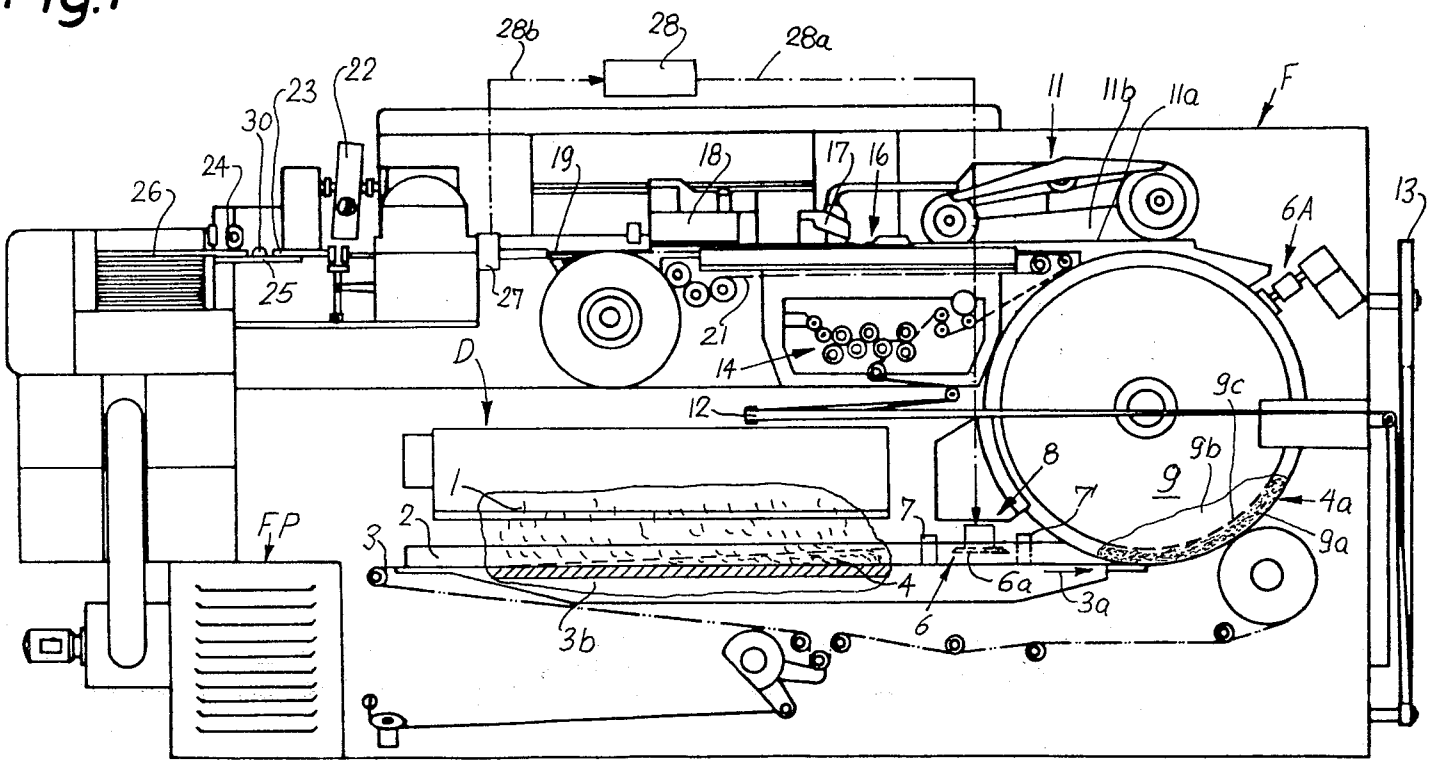
FIG. 1 is a somewhat schematic elevational view of a cigarette rod making machine including an apparatus which embodies one form of the present invention, a portion of the cigarette making machine being shown in a vertical sectional view.

FIG. 1 illustrates a cigarette rod making machine which is known as GARANT and is manufactured and sold by the assignee of the present application. This machine comprises a frame or housing which accommodates a distributor D of the type disclosed, for example, in commonly owned U.S. Pat. Nos. 3,996,943 and 3,996,944 granted Dec. 14, 1976 to Alfred Hinzmann. The disclosures of the Hinzmann patents are incorporated herein by reference. The distributor D comprises a system of conveyors which deliver a carpet 1 of tobacco shreds and shower such shreds into an elongated narrow tobacco channel 2 the bottom wall of which is constituted by the upper reach of a foraminous tobacco conveyor belt 3 which advances in the direction indicated by arrow 3*a*. The particles which deposit on the upper reach of the conveyor 3 are attracted by suction in a chamber 3*b* below the upper reach of the conveyor 3 and form a wedge-like growing tobacco stream 4 advancing toward a trimming or equalizing device 6. The purpose of the equalizing device 6 is to remove from the fully grown tobacco stream 4 the surplus of tobacco shreds so that the stream 4 is converted into a continuous tobacco filler 4*a* of constant or substantially constant height. The level of the material removing knife or knives 6*a* of the trimming device 6 can be varied in dependency on a signal which is transmitted by way of conductor means 28*a*. In other words, signals which are transmitted via conductor means 28*a* can initiate a movement of the knife or knives 6*a* nearer to or further away from the upper reach of the conveyor 3 above the suction chamber 3*b*.

The apparatus of the present invention serves to regulate the position of the knife or knives 6*a* so as to ensure that each and every increment of the filler 4*a* will contain an adequate quantity or mass of tobacco particles. To this end, the apparatus comprises two monitoring devices 7 and 8 which are shown schematically in FIG. 1 and in greater detail in FIG. 2. The monitoring device 7 is installed adjacent to the path of movement of the fully grown tobacco stream 4 ahead of the trimming device 6, i.e., ahead of that portion of the path for the stream 4 where the surplus of fibrous material is removed. However, it is equally possible to install this monitoring device downstream of the trimming device 6; this is indicated in FIG. 1 by broken line as at 7'. The monitoring device 7' then generates signals denoting the height of successive increments of the trimmed stream (filler 4*a*), i.e., the distance between the sides 4A and 4B (see FIG. 2) of the trimmed stream.

The cigarette making machine of FIG. 1 further comprises a wheel-shaped conveyor 9 having a circumferential groove 9*a* surrounding a suction chamber 9*b* and having a foraminous bottom wall 9*c* so that suction in the chamber 9*b* can attract particles of tobacco which are admitted into the groove 9*a*. The latter receives the tobacco filler 4*a* from the upper reach of the conveyor 3 at the 6 o'clock position of the conveyor 9, and such filler is thereupon transported through an angle of approximately 180° past an optional second or auxiliary trimming device 6A which is installed substantially at the one-half o'clock position of the wheel 9. A transfer conveyor 11 removes successive increments of the twice-trimmed filler 4*a* from the groove 9*a* and transfers the filler onto the upper reach of an endless belt conveyor 21 known as garniture. The transfer conveyor 11 comprises an endless foraminous belt 11*a* which may consist of a metallic material and the lower reach of which travels above a suction chamber 11*b* serving to attract the filler 4*a* during transfer onto the garniture 21.

A bobbin or reel of 13 of cigarette paper web 12 is supported on the frame to the right of the wheel 9, as viewed in FIG. 1. The web 12 is drawn off the bobbin 13 and advances to an imprinting mechanism 14 of known design. The purpose of the mechanism 14 is to provide spaced apart portions of the web 12 with printed matter denoting the trademark of the manufacturer, the name or initials of the manufacturer and/or other indicia. Successive increments of the thus treated web 12 are delivered onto the upper reach of the garniture 21 below the filler 4*a*, and the web 12 thereupon passes through a combined compacting or condensing and wrapping mechanism 16 of known design wherein the web is draped around the filler 4*a* in such a way that one marginal portion of the web extends upwardly and is coated with a film of adhesive paste during travel along a suitable paster 17. The mechanism 16 thereupon folds the adhesive-coated marginal portion of the web 12 over the other marginal portion so that the two marginal portions form a continuous seam which extends in the longitudinal direction of the resulting continuous cigarette rod 19. The seam is heated or dried by a sealer 18 which promotes the setting of adhesive by applying or removing heat from the seam, depending upon the nature of the adhesive paste.

Successive increments of the continuously advancing cigarette rod 19 pass through a cutoff 22 which severs the rod 19 at regular intervals so that the rod yields a single file of discrete plain cigarettes 23 of desired (e.g., unit) length. Such cigarettes are accelerated by a rotary accelerating cam 24 and propelled into successive flutes at the periphery of a rotary drum-shaped row forming conveyor 26 which converts the single file of cigarettes 23 into one or more rows wherein the cigarettes travel sideways. The cigarettes 23 are thereupon transported to storage, to a filter tipping machine (e.g., a machine of the type known as MAX or MAX S produced by the assignee of the present application) or to a packing machine, not shown. A guide 25 defines a horizontal path for cigarettes 23 between the cutoff 22 and the conveyor 26.

The manner in which the garniture 21 is driven to draw the web 12 off the bobbin 13 and to advance the filler 4*a* along its upper reach is known and is not specifically shown in the drawing. A suitable prime mover (e.g., a variable-speed electric motor) is installed in the portion FP of the frame.

The reference character 27 denotes in FIG. 1 a density measuring or monitoring device (preferably a device which utilizes a source of corpuscular radiation, such as beta rays) which is mounted ahead of the cutoff 22 and is adjacent to the path of movement of the cigarette rod 19 (wrapped and condensed filler 4*a*). The device 27 monitors the density of successive increments of the condensed filler 4*a* in the rod 19 and transmits corresponding signals to a control circuit 28 by way of conductor means 28*b*. The control circuit 28 compares such signals with a reference signal denoting the desired or optimum density of the filler 4*a* in the rod 19. If the actual density of measured increments of the filler 4*a* in the rod 19 deviates from the desired density, the output of the control circuit 28 transmits a signal by way of the conductor means 28*a*, and such signal is utilized to raise or lower the knife or knives 6*a* of the trimming device 6 so as to change the quantity of tobacco shreds in successive increments of the filler 4*a* which is about to enter the groove 9*a* at the periphery of the conveyor 9. In other words, the circuit 28 causes the plane of the knife or knives 6*a* to move toward or away from the plane of the upper reach of the conveyor 3 (i.e., toward or away from the side 4A of the fully grown stream 4) when the intensity of another characteristic of the signal transmitted by the monitoring device 27 warrants such change in the location or level of the knife or knives 6*a*. The side 4B of the stream 4 is located opposite the side 4A.

The machine of FIG. 1 further comprises an ejector 30 which is preferably a nozzle adjacent to a portion of the path of movement of discrete cigarettes 23 downstream of the cutoff 22 (along the guide 25) and serving to discharge jets of compressed air whenever a defective cigarette 23 is adjacent to its orifice. The ejected (defective) cigarette 23 is propelled into a suitable collecting receptacle, not shown in FIG. 1. The mode of operation of the ejector including the nozzle 30 will be described with reference to FIG. 2. The nozzle 30 prevents unsatisfactory articles 23 from reaching the next processing (e.g., storing or packing or filter tipping) station.

FIG. 2 illustrates the details of the monitoring device 7 which is installed upstream of the trimming device 6 shown in FIG. 6. The monitoring device 7 serves to ascertain the height of the fully grown tobacco stream 4 prior to initial trimming and constitutes an opto-electronic detector arrangement having a source 29 of infrared radiation discharging a divergent beam of light rays against one side of an optical element 31 which causes the rays to travel along parallel paths toward and in part through a first mirror 32. The rays thereupon impinge upon a fully reflecting mirror 33 and are thereby deflected against a second fully reflecting mirror 34. The path of the fully grown tobacco stream 4 extends at right angles to the plane of FIG. 2 between the mirrors 33 and 34 of the monitoring device 7. The underside of the stream 4 rests on the upper side of the upper reach of the conveyor 3. As shown by broken lines at 36, the light rays which are reflected by the mirror 33 and are not intercepted by the tobacco stream 4 impinge upon and are reflected by the mirror 34 so that they are reflected back against the mirror 33 which reflects such rays against the underside of the mirror 32. The latter reflects the rays 36 against the corresponding photocells 38 of a transducer 37. The light rays 36*a* which are intercepted by the tobacco stream 4 are indicated in FIG. 2 by solid lines. The number of rays 36 depends on the height of the stream 4, i.e., the number of photocells 38 which receive reflected light also depends on the height of the stream 4, namely, on the extent of overlap between the stream 4 and the mirrors 33, 34 of the monitoring device 7. The transducer 37 comprises a row of superimposed photocells 38. In the illustrated embodiment, such row contains a total of seven photocells but this number can be increased above or reduced below seven without departing from the spirit of the invention.

The signals which are transmitted by the upper three cells 38 (namely those cells which receive light from the mirror 32) are amplified by an amplifier 39 and totalized in a summing circuit 41. The (first) signal at the output of the summing circuit 41 is transmitted to a signal comparing stage 42 which further receives a (second) signal from the monitoring device 8. The device 8 can be attached to and then shares the movements of the equalizing device 6 in response to signals via conductor means 28*a*. The monitoring device 8 may constitute an inductive distance measuring device of conventional design. A suitable inductive distance measuring device is that known as Linear Motion SS-104, S/M 4886 manufactured by the Collins Corporation.

The signal comparing stage 42 subtracts one of the transmitted signals from the other signal and transmits a third signal whose intensity corresponds to the difference between the intensities or other characteristics of the two received (first and second) signals to a threshold circuit 46. The threshold circuit 46 comprises a signal comparing stage 47 and an associated source 48 of reference (threshold) signals, such as a variable potentiometer. If the intensity of signal which is transmitted by the signal comparing stage 42 to the signal comparing stage 47 is less pronounced than the intensity of the threshold signal which is transmitted by the source 48, the output of the stage 47 transmits a corresponding (third) signal to an amplifier 49 which, in turn, transmits the signal to the solenoid of a valve 51 in a conduit 53 which connects the aforementioned ejector nozzle 30 with a source 52 of compressed gaseous fluid, such as air. The connection between the stage 47 and the amplifier 49 comprises a time-delay device 54 which ensures that the nozzle 30 discharges one or more jets of compressed gaseous fluid at the exact moment when the filler section or sections which has or have caused the monitoring device 7 to transmit the corresponding first signal or signals to the transducer 37 reaches or reach the region in front of the orifice of the nozzle 30, i.e., that portion of the path for articles 23 from which the selected (defective) articles must be segregated by the nozzle 30. The time-delay device 54 may constitute a conventional shift register which receives signal-advancing pulses from a pulse generator driven in synchronism with the garniture 21 of the cigarette rod making machine shown in FIG. 1. Reference may be had to commonly owned U.S. Pat. No. 3,996,942 granted Dec. 14, 1976 to Anton Baier. FIG. 2 of the patent shows the combination of a shift register, a pulse generating device and an ejecting device for defective rod-shaped articles. The disclosure of this patent is incorporated herein by reference.

It can be said that the time-delay device 54 ensures that the transport of third signals to the ejecting or segregating nozzle 30 takes place in simulation of transport to the orifice of this nozzle of those portions of the filler 4*a* which have caused the generation of corresponding third signals.

As shown in FIG. 3, the opto-electronic monitoring device 7 of FIG. 2 can be replaced with a capacitive monitoring device 107, i.e., with a device for capacitive measurement of the height of successive increments of the tobacco stream 104 (namely, of the distance between the sides 104A and 104B of such stream). This device resorts to a high-frequency electric alternating field and comprises a capacitor 156 having two spaced apart plate-like electrodes 157, 158 flanking the path of the fully grown tobacco stream 104. The electrodes 157 and 158 form part of a high-frequency oscillator circuit 159. The details of such a monitoring device are disclosed in the commonly owned U.S. Pat. No. 3,795,984 granted Mar. 12, 1974 to Gerhard Meyer. Monitoring devices of the type shown in FIG. 3 are normally employed to ascertain the mass of a tobacco stream. However, and since the electrodes 157, 158 confine the tobacco stream 104 in such a way that, when the quantity or density of the stream varies, only the height of the tobacco stream 104 (i.e., the distance between the sides 104A and 104B) fluctuates, the monitoring device 107 is evidently capable of ascertaining any and all variations of the height of the stream 104. The output of the oscillator circuit 159 transmits a corresponding signal to the amplifier 39 of the circuit shown in FIG. 2, and such signal is thereupon processed in the same way as described in connection with the signals furnished by the transducer 37 shown in FIG. 2. In other words, the (first) signal from the oscillator 159 is amplified and transmitted to the corresponding input of the stage 42 which further receives (second) signals from the monitoring device 8.

Referring finally to FIG. 4, there is shown a monitoring device 207 which can replace the monitoring device 7 of FIG. 2 or the monitoring device 107 of FIG. 3. The device 207 comprises a first enclosure or housing 261 which flanks a portion of one side of the path of the fully grown tobacco stream 204 and contains a sound-emitting device 262, preferably a device which transmits non-audible sound waves (i.e., the so-called ultrasound). A second enclosure or housing 263 is located opposite the housing 261 and contains a sound-receiving device 264. The emitter 262 may constitute a piezoelectric crystal which receives voltage pulses from an electric oscillator 266. The receiver 264 also constitutes a piezoelectric crystal which is connected with an evaluating circuit 267. The details of a monitoring device of the type shown in FIG. 4 are disclosed and claimed in commonly owned U.S. Pat. No. 3,914,989 granted Oct. 28, 1975 to Joachim Reuland et al. The disclosures of this patent and of the previously mentioned U.S. Pat. No. 3,795,984 are incorporated herein by reference. The output signal (first signal) of the evaluating circuit 267 denotes the height of the corresponding increment of the stream 204 (i.e., the distance between the sides 204A and 204B of such stream) and is transmitted to the amplifier 39 of the circuit shown in FIG. 2 for comparison with the (second) signal from the monitoring device 8 and for further processing in a manner as shown in the right-hand portion of FIG. 2.

A height monitoring device which utilizes one or more sources of infrared light (see the device 7 of FIG. 2) and can ascertain the distance between two sides (such as 4A and 4B) of successive increments of the moving (trimmed or untrimmed) stream without actually contacting the stream is preferred at this time because it is not prone to malfunction and can stand long periods of use with a minimum of maintenance. Similar monitoring devices are disclosed in commonly owned U.S. Pat. Nos. 4,190,061 and 4,236,534 respectively granted on Feb. 26 and Dec. 2, 1980 to Uwe Heitmann et al. Commonly owned U.S. Pat. No. 4,063,563 granted Dec. 20, 1977 to Heinz-Christen Lorenzen discloses a cigarette rod making machine with two height monitoring detectors, one ahead of and the other downstream of the trimming device. Commonly owned U.S. Pat. No. 4,037,608 granted July 26, 1977 to Günter Wahle discloses the combination of a beta ray detector and an adjustable tobacco trimming device in a cigarette rod making machine.

An important advantage of the improved method and apparatus is that they facilitate reliable detection of short or long filler sections which contain less than a minimum acceptable quantity of fibrous material. Such detection is reliable at a low as well as at an extremely high speed of the filler, e.g., when the machine turns out 100 or even more rod-shaped articles per second (this corresponds to a filler speed in excess of 400 meters per minute). More specifically, the improved apparatus can detect those sections of the filler which are formed of tobacco stream sections or portions whose height (e.g., as measured between the sides 4A and 4B of the stream 4), prior or after trimming, is less than the distance between the plane of the upper reach of the conveyor 3 and the plane of the knife or knives 6*a*. Such portions or sections of the stream exhibit pronounced valleys in the side 4B, i.e., the height of the tobacco stream portions or sections in the region of each pronounced valley must be less than the distance between the plane of the upper reach of the conveyor 3 and the plane of the knife or knives 6*a;* this enables the improved apparatus to generate one or more third signals which effect segregation of corresponding (unsatisfactory) articles 23 from the path for transport of satisfactory articles to the next processing station. In other words, the apparatus of the present invention ensures that only those articles 23 which contains sufficient quantities of fibrous material can reach the next processing station.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of detecting those portions of a continuous rod-like filler of fibrous material, especially a filler consisting of or containing shredded and/or otherwise comminuted tobacco, which contain less than a desired quantity of fibrous material, comprising the steps of forming a continuous stream of variable height at least the major part of which normally contains a surplus of fibrous material; conveying the stream lengthwise in a predetermined direction and along a predetermined path so that one side of the stream is located in a first plane and the distance between such one side and another side of the stream which is located opposite the one side varies as a function of variations of the height of the stream; removing the surplus at the other side of the stream in a predetermined first portion of said path, including trimming the stream in a second plane which is spaced apart from said first plane whereby the thus trimmed stream is converted into said filler; condensing the filler and draping the filler into a web of wrapping material to form a continuous wrapped filler in a second portion of said path downstream of said first portion; monitoring the density of the filler downstream of said first portion of said path and changing the position of one of said planes with reference to the other of said planes as a function of deviations of monitored density from a predetermined density; monitoring the height of successive increments of the stream upstream of said second portion of said path and generating first signals denoting the height of the respective increments; monitoring the distance between said planes and generating second signals denoting such distance; comparing said first and second signals; and generating third signals denoting the differences between said first and second signals.

2. The method of claim 1, wherein said step of generating third signals includes generating a third signal when the difference between said first and second signals is less than a predetermined threshold value.

3. The method of claim 2, further comprising the steps of subdividing the wrapped filler into rod-shaped articles of preselected length, conveying the articles along a second path, and utilizing said third signals for segregation from said second path of those selected articles whose fillers have caused the generation of corresponding first signals.

4. The method of claim 3, wherein said density monitoring step comprises monitoring the density of successive increments of the wrapped filler.

5. The method of claim 3, wherein said utilizing step comprises expelling said selected articles from a predetermined portion of said second path and further comprising the step of delaying the application of said third signals for segregation of the corresponding selected articles until such articles reach said predetermined portion of said second path.

6. The method of claim 1, wherein said step of monitoring the height of successive increments of the stream comprises ascertaining such height by a monitoring device which is out of contact with the stream.

7. The method of claim 6, wherein said ascertaining step comprises generating said first signals in the form of electric signals whose characteristics vary as a function of variations of the height of the stream.

8. The method of claim 7, wherein said ascertaining step further comprises moving the stream past the monitoring device so that the stream and the monitoring device overlap each other, the characteristics of said electric signals being a function of the extent of overlap between the monitoring device and the stream.

9. The method of claim 1, wherein said height monitoring step comprises opto-electronically scanning the distance between the first and second sides of the stream.

10. The method of claim 9, wherein said scanning step includes directing infrared radiation against successive increments of the stream.

11. The method of claim 1, wherein said height monitoring step comprises ascertaining the distance between said sides of the stream with sound waves.

12. The method of claim 11, wherein said sound waves are non-audible waves.

13. The method of claim 12, wherein said sound waves are ultrasound waves.

14. The method of claim 1, wherein said step of monitoring the height of successive increments of the stream includes capacitively measuring the distance between said sides of the stream.

15. The method of claim 14, wherein said measuring step includes resort to a high-frequency electric alternating field.

16. The method of claim 1, wherein said height monitoring step includes measuring the distance between said sides of the stream ahead of said first portion of said path, as considered in said direction.

17. The method of claim 1, wherein said height monitoring step includes measuring the distance between said sides of the stream downstream of said first portion of said path, as considered in said direction.

18. In a machine for making a continuous rod-like filler of fibrous material, especially a filler consisting of or containing shredded and/or otherwise comminuted tobacco, conveyor means including a portion disposed in a first plane and defining an elongated path; means for supplying fibrous material into said path so that such material forms an elongated stream of varying height which moves lengthwise in a predetermined direction and at least the major portion of which normally contains a surplus of fibrous material, said stream having a first side adjacent to said conveyor means and a second side disposed opposite said first side and the distance between said first and second sides varying as a function of variations of the height of the stream; trimming means for removing the surplus of fibrous material at said second side of the stream and for thus converting the stream into a filler, including a material removing device disposed in a second plane spaced apart from said first plane; means for converting the filler into a wrapped filler in a predetermined portion of said path; and apparatus for detecting those portions of the filler which contain less than a desired quantity of fibrous material, including means for monitoring the density of the filler downstream of said trimming means, means for varying the distance between said planes as a function of deviations of the density of the filler from a predetermined density, means for monitoring the height of successive increments of the stream on said conveyor means upstream of said portion of said path including first signal generating means for generating first signals denoting the height of the respective increments of the stream, means for monitoring the distance between said planes including second signal generating means for generating second signals denoting such distance, and third signal generating means for generating third signals denoting the differences between said first and second signals, said third signal generating means comprising means for comparing said first and second signals.

19. The structure of claim 18, wherein said comparing means further comprises means for comparing the difference between said first and second signals with a predetermined threshold value and generating a third signal when the difference between the first and second signals is less than said threshold value.

20. The structure of claim 19, wherein said filler converting means comprises means for condensing the filler and for draping the filler into a web of wrapping material, and further comprising means for subdividing the wrapped filler into a series of discrete rod-shaped articles, means for conveying the articles along a second path, means for segregating selected articles from said second path in response to said third signals, and means for delaying the transmission of third signals to said segregating means in simulation of transport into the range of said segregating means of those portions of the filler which have caused the generation of the corresponding third signals.

21. The structure of claim 18, wherein said height monitoring means comprises means for contactless measurement of the distance between the first and second sides of the stream.

22. The structure of claim 18, wherein said height monitoring means includes opto-electronic means for measuring the distance between the first and second sides of the stream.

23. The structure of claim 18, wherein said height monitoring means comprises a source of infrared light.

24. The structure of claim 18, wherein said height monitoring means includes a source of sound waves.

25. The structure of claim 24, wherein said source is arranged to emit non-audible sound waves.

26. The structure of claim 25, wherein said non-audible waves are ultrasound waves.

27. The structure of claim 18, wherein said height monitoring means includes means for capacitive measurement of the distance between the first and second sides of the stream.

28. The structure of claim 27, wherein said means for capacitive measurement includes a high-frequency oscillator circuit having a capacitor including electrodes flanking a portion of said path.

29. The structure of claim 18, wherein said height monitoring means is located ahead of said trimming means, as considered in said direction.

30. The structure of claim 18, wherein said height monitoring means is located downstream of said trimming means, as considered in said direction.

31. The structure of claim 18, wherein said density monitoring means comprises a source of corpuscular radiation.

32. The structure of claim 18, wherein said means for varying the distance between said planes includes means for effecting movements of said material removing device toward and away from said portion of said conveyor means.

33. The structure of claim 32, wherein said means for monitoring the distance between said planes is arranged to share the movements of said material removing device with reference to said portion of said conveyor means.

* * * * *